US005121563A

United States Patent [19]

Connor et al.

[11] Patent Number: 5,121,563

[45] Date of Patent: * Jun. 16, 1992

[54] SNAP-IT CARD DISPLAY HOLDER

[75] Inventors: John K. Connor; Charles M. Connor, Jr.; H. B. Stroup, Jr., all of Asheville, N.C.

[73] Assignee: Collector's Products Corporation, Asheville, N.C.

[ * ] Notice: The portion of the term of this patent subsequent to Oct. 15, 2008 has been disclaimed.

[21] Appl. No.: 566,568

[22] Filed: Aug. 13, 1990

Related U.S. Application Data

[63] Continuation-in-part of Ser. No. 376,816, Jul. 7, 1989.

[51] Int. Cl.[5] ..... G09F 3/18

[52] U.S. Cl. ..... 40/661; 206/45.34; 40/152.1

[58] Field of Search ..... 40/159.2, 152.1, 156, 40/323, 661, 642; 248/455; 206/37.1, 45.34, 455, 456; 150/145, 149

[56] References Cited

U.S. PATENT DOCUMENTS

| | | | |
|---|---|---|---|
| 2,931,118 | 4/1960 | Riedel | 40/152 |
| 2,968,884 | 1/1961 | Anastasio et al. | 40/152 |
| 3,576,083 | 4/1971 | Perrot | 40/152 |
| 4,322,001 | 3/1982 | Hurley | 206/45.34 X |
| 4,351,124 | 9/1982 | Sivertsen et al. | 40/159.2 |
| 4,431,114 | 2/1984 | Kleinfeld | 206/45.34 X |
| 4,443,959 | 4/1984 | Ackeret | 40/642 X |
| 4,798,031 | 1/1989 | George | 40/607 X |
| 4,829,691 | 5/1989 | Manjos et al. | 40/642 X |
| 4,979,619 | 12/1990 | Hager | 40/156 X |

FOREIGN PATENT DOCUMENTS

| | | | |
|---|---|---|---|
| 446070 | 3/1949 | Italy | 40/152.1 |
| 608653 | 9/1960 | Italy | 248/455 |
| 917352 | 2/1963 | United Kingdom | 40/159.2 |

*Primary Examiner*—Laurie K. Cranmer
*Assistant Examiner*—Brian K. Green
*Attorney, Agent, or Firm*—Ralph H. Dougherty

[57] ABSTRACT

A card display holder for a display item includes a clear base panel having a top surface and a bottom surface and a top surface area greater than the display item. The top surface has a recessed portion for containing the display item. A clear cover panel also has a top surface and a bottom surface with a bottom surface area greater than the display item. Mechanisms for slidably engaging the cover panel with the base panel and for locking the cover panel to the base panel are also provided. An attachable device is provided for standing the holder upright and adjusting the viewing angle.

23 Claims, 4 Drawing Sheets

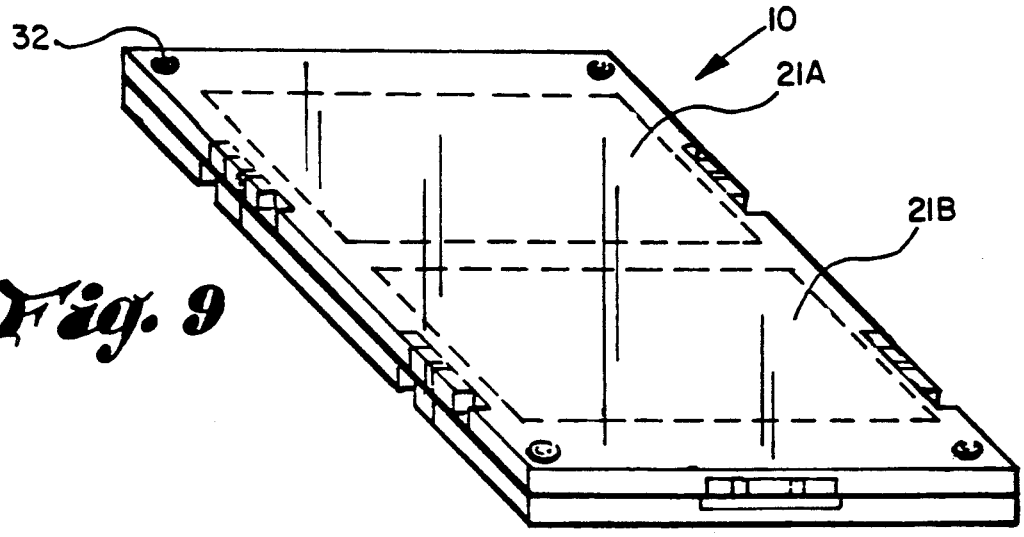
Fig. 9
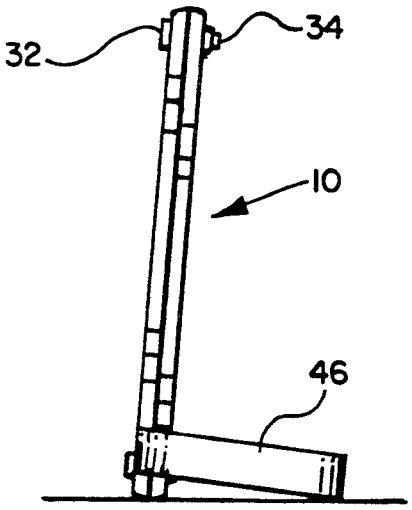
Fig. 10
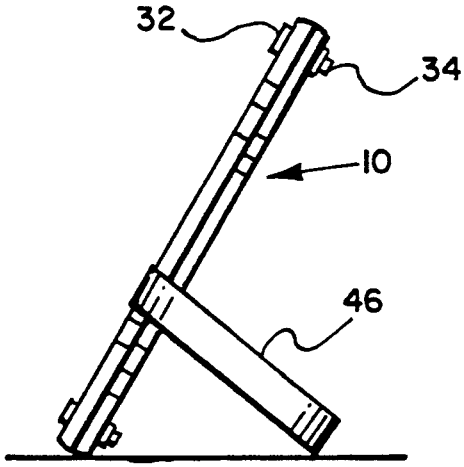
Fig 11
Fig. 12
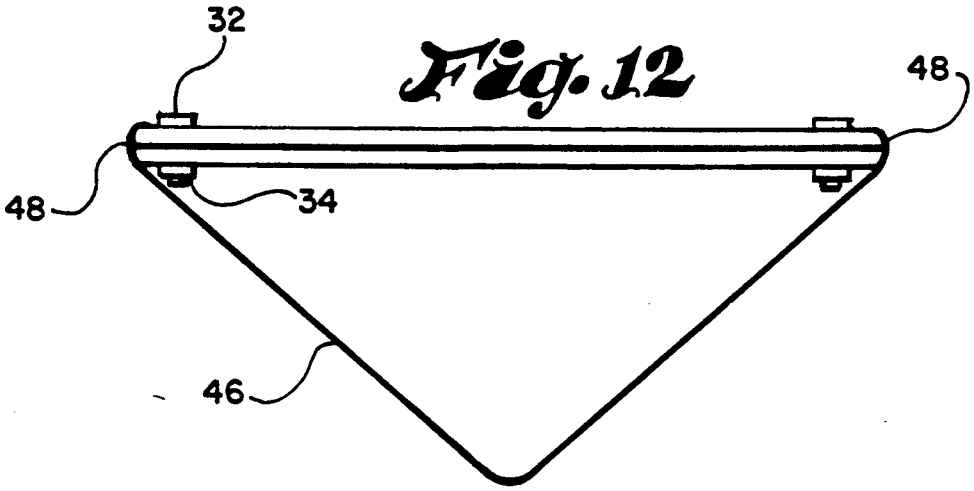

SNAP-IT CARD DISPLAY HOLDER

CROSS REFERENCE TO RELATED APPLICATION

This application is a continuation-in-part of co-pending application Ser. No. 07/376,816 filed July 7, 1989.

BACKGROUND OF THE INVENTION

1. Field of the Invention

The present invention generally relates to display devices and, more particularly, is concerned with an improvement to plastic card holders for containing and displaying an assortment of display items.

2. Description of Related Art

SNAP-IT TM, which is the subject of co-pending application Ser. No. 07/376,816, provides baseball card collectors and dealers with a product that holds, protects and displays a single baseball card that is quick and simple to use. The present invention, distributed under the trademark SNAP-IT II TM, provides an improvement upon the plastic card holder described in the prior application by providing means for slidably engaging and locking a cover panel to a base panel. The improved holder accomplishes the objects of the first holder, but provides a more secure mechanism for holding and displaying the display item or items between the two panels, and has been tested by being dropped several times from substantial heights without the two panels becoming disengaged.

In collector's circles, it is important to protect display items, such as cards, from damage by exposure to the elements or by periodic handling. Obviously, a well preserved baseball card, for example, will be worth more to a collector, both in terms of personal viewing pleasure and in terms of monetary value. It is also important for both dealers and collectors to be able to handle individual cards for the purpose of displaying, trading and selling them, but without impairing the view of each card. Thus it is advantageous to provide a means by which the external surfaces of the holding device are protected from damage, particularly from scratching. It is also advantageous to provides a secure mechanism for holding and displaying a display item or items.

Some card holder devices are made with multiple parts. Card replacement typically requires unscrewing a number of screws from associated nuts, removing the top half, swapping the card, carefully aligning the card, carefully replacing the top without moving the card, and reinstalling and retightening the screws to the nuts. Obviously, this is a time consuming and painstaking process. In addition, some currently used devices use threaded holes for receiving the screws, which greatly increase the cost of the device. In summary, current holder devices which firmly secure display items in place are typically complex and difficult to open and close.

Applicants are aware of the following patents concerning card holder devices and related protective devices.

| Pat. No. | Issue Date | Inventor | Title |
|---|---|---|---|
| 4,829,691 | May 16, 1989 | Manjos et al. | CARD DISPLAY HOLDER AND PROTECTOR |
| 4,443,959 | Apr 24, 1984 | Ackeret | STACKABLE PHOTOGRAPH HOLDERS |
| 4,524,867 | Jun 25, 1985 | Klein et al. | CASE FOR ACCOMMODATING WRITTEN MATERIAL FOR PRESENTATION PURPOSES |
| 3,949,505 | Apr 13, 1976 | Kato | QUICKLY INTERCHANGEABLE SLIDE MOUNTS |
| 847,052 | Mar 12, 1907 | Englefield | BOOK-REST AND THE LIKE |
| 3,029,548 | Apr 17, 1962 | Braha | BOOK HOLDER |
| 3,581,422 | Jun 1, 1971 | Kondo | FILM HOLDER FOR SLIDE PROJECTOR |
| 4,703,853 | Nov 3, 1987 | Byrns | BLOW-MOLDED THREE SECTION STORAGE CASE |
| 4,745,695 | May 24, 1988 | Hetzer | INFORMATION CARRIER HOLDING RAIL |
| 4,869,364 | Sep 26, 1989 | Bray | CONTAINER FOR THIN OBJECTS |
| ITALY 608653 | Sep 19, 1960 | Milano | VARIABLE INCLINE SUPPORT |
| UK 2 092 329 | Aug 11, 1982 | Buddle | PHOTOGRAPHIC SLIDE MOUNTS |

Manjos, et al. teaches a display device and protector suitable for holding a card or card-like object, in which two sides are connected. The Manjos device has more limited life than that of the applicants because the fold line will become weakened and fail. Manjos also requires more expensive equipment to produce. Still another distinguishing feature of the present invention is the novel means for adjusting the viewing angle of the assembled card display holder. No such means is disclosed in Manjos, nor is any slidably engaging means.

Each of the remaining patents relates generally to one or more aspects of the present invention but differ in structure and operation from the present invention.

Applicants are unaware of any prior art that accomplishes the objects of the present invention. Consequently, a need exists for a device for, among other things, slidably engaging and locking a cover panel to a base panel and displaying various items, such as a baseball card.

SUMMARY OF THE INVENTION

The present invention is an innovative card display holder, which overcomes the problems and satisfies the needs considered above.

The invented card display holder includes a clear base panel having a top surface and a bottom surface and a top surface area greater than the display item. The top surface has a recessed portion for containing the display item. A clear cover panel also has a top surface and a bottom surface with a bottom surface area greater than the display item. Mechanisms for slidably engaging the cover panel with the base panel and for locking the cover panel to the base panel are also provided. An attachable support is provided for standing the holder upright and adjusting the viewing angle.

In summary, the invention encompasses two clear plastic panels that snap firmly together and may be separated for insertion of an item in a recess in one panel. The invention holds, protects and displays a single display item such as a baseball card.

OBJECTS OF THE INVENTION

The principal object of the present invention is to provide baseball card collectors and dealers with a product that holds, protects and displays a single baseball card that is quick and simple to use.

It is also an object to provide a card display holder that allows selective viewing of both front and back of an item.

Another object of the invention is to provide a card display holder having a positive locking mechanism for securing the display item in the card display holder.

Another object of the invention is to provide a card display holder having means for stacking for transportation and storage without scratching or damaging an adjacent card display holder.

Another object of the invention is to provide a card display holder for display of other small items, such as stamps, coins, paper currency, newspaper articles, and pictures.

It is a further object of the invention to provide a means for standing the card display holder upright and adjusting the viewing angle.

Another object of the invention is to provide a more secure mechanism for holding and displaying a display item or items between two panels.

Another object of the invention is to provide a card display holder which may be dropped from substantial heights without the two panels of the holder becoming disengaged.

BRIEF DESCRIPTION OF THE DRAWINGS

The foregoing and other objects will become more readily apparent by referring to the following detailed description and the appended drawings in which:

FIG. 9 is an alternative embodiment of the invention shown in FIG. 1, having a plurality of recesses for receiving display items.

FIG. 10 is a side view of the invention showing an adjustable V-shaped support for adjusting the viewing angle of the card display holder.

FIG. 11 is a side view of the card display holder and V-shaped support shown in FIG. 10, showing the card display holder positioned at an inclined viewing angle.

FIG. 12 is a top view of the card display holder and V-shaped support shown in FIG. 10, but in vertical orientation.

DETAILED DESCRIPTION

Figure 1:
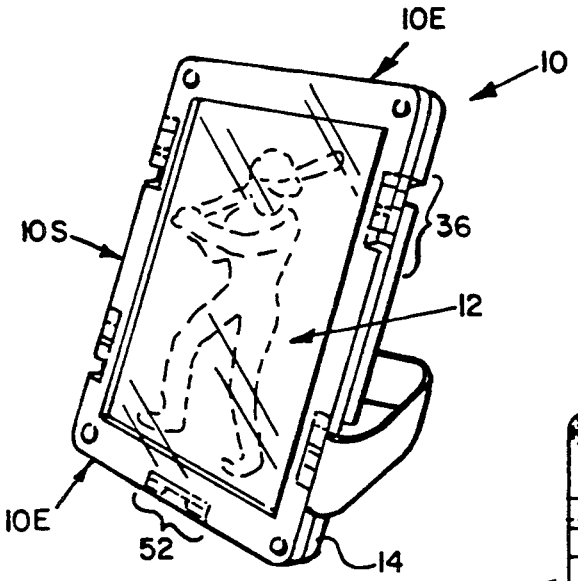
FIG. 1 is an isometric view of the invention in use with a baseball card.

Referring now to the drawings, and more particularly to FIG. 1, a card display holder, generally designated 10, comprises the preferred embodiment of the present invention.

Figure 2:
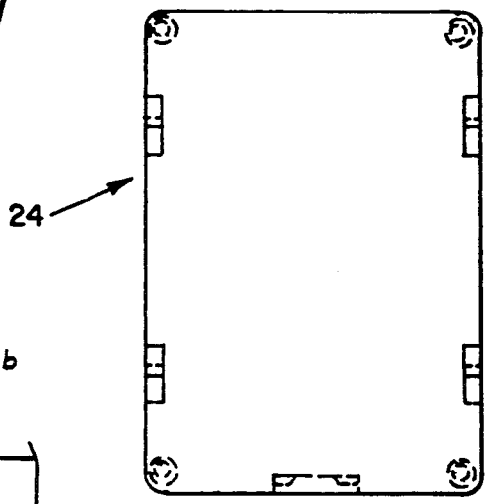
FIG. 2 is a plan view of the bottom surface of the cover panel of the invented card display holder.
Figure 3:
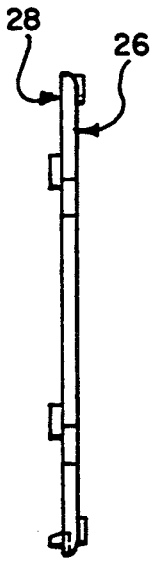
FIG. 3 is a side elevation of the cover panel shown in FIG. 2.
Figure 4:
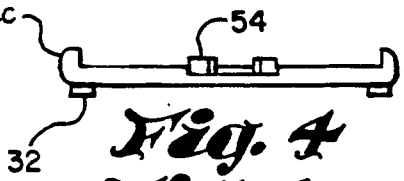
FIG. 4 is an end elevation of the cover panel shown in FIG. 2.
Figures 8A, 8B:
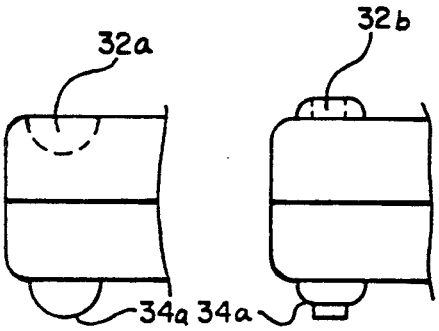
FIG. 8*a* is an alternative embodiment of the invention shown in FIG. 8, illustrating alternate means for stacking card display holders.
FIG. 8*b* is an alternative embodiment of the invention shown in FIG. 8, illustrating alternate means for stacking card display holders.
Figure 5:
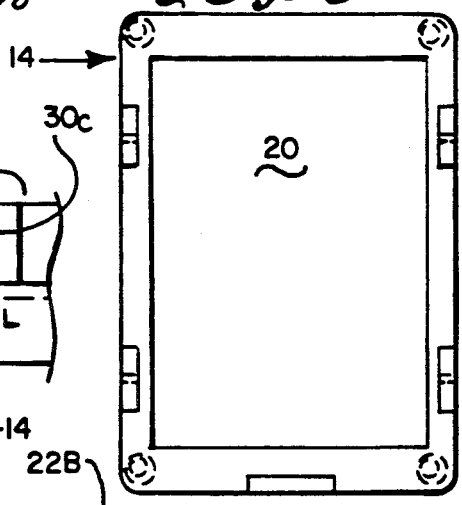
FIG. 5 is a plan view of the top surface of the base panel according to the invention.
Figure 6:
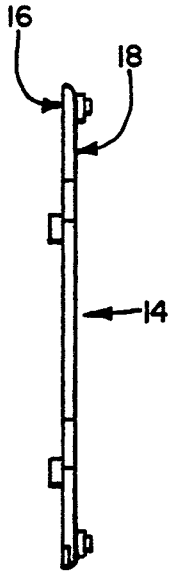
FIG. 6 is side elevation of the base panel shown in FIG. 5.
Figure 8:
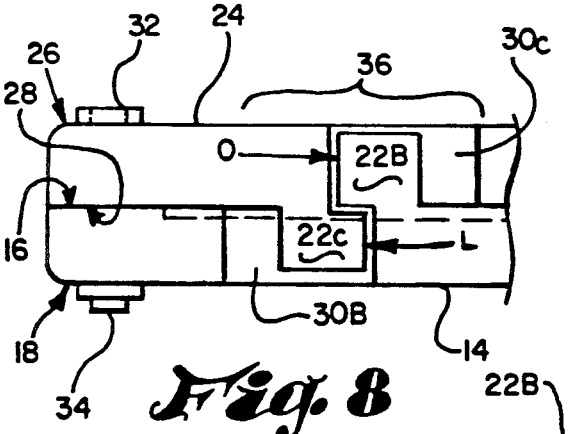
FIG. 8 is an enlarged view of a portion of the invented card display holder, showing details of means for slidably engaging the cover panel with the base panel.
Figure 7:
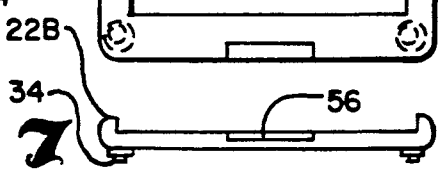
FIG. 7 is an end elevation of the base panel shown in FIG. 5.
Figure 13:
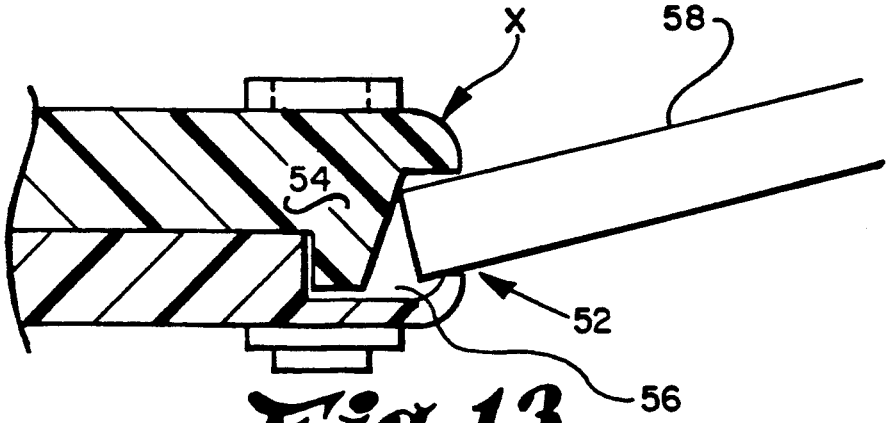
FIG. 13 is an enlarged cross section of the locking portion of the card display holder, and indicating the preferred means for both locking the cover panel to and unlocking the cover panel from the base panel.
Figure 14:
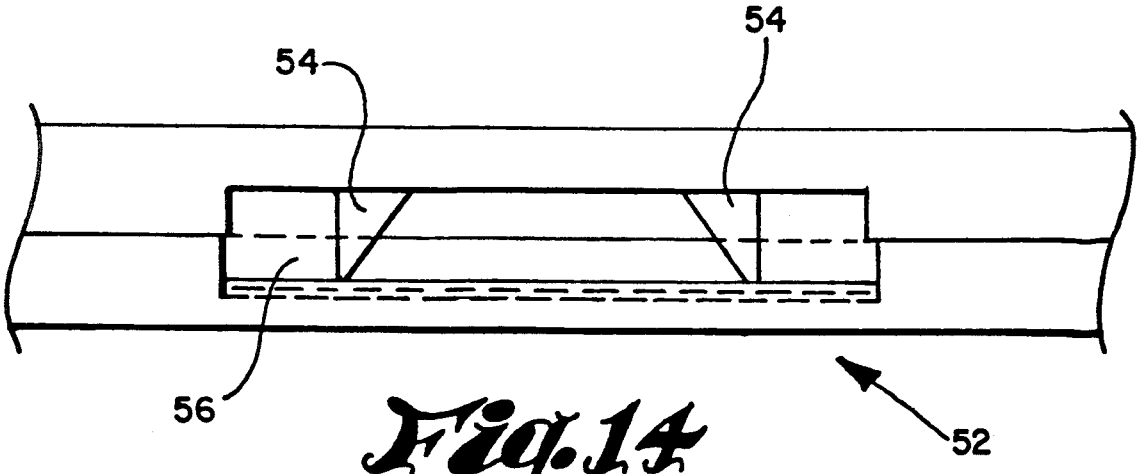
FIG. 14 is an end view of the locking means shown in FIG. 13.

The card display holder 10 for receiving a display item 12, includes a clear base panel 14, having a top surface 16 and a bottom surface 18, as shown in FIG. 6. The surface area of the base panel 14 is greater than that of the display item 12. The top surface 16 has a recessed portion 20, for containing the display item 12 preferably just slightly larger than and having the configuration of the display item 12. A clear cover or cover panel 24, as shown in FIGS. 2 and 3, also has a top surface 26, a bottom surface 28, and a surface area greater than the display item 12. The base and cover panels 14, 24 are preferably rectangular, and with rounded corners.

A key feature of the present invention is means 36 for slidably engaging the cover panel 24 with the base panel 14. A plurality of notch/engager pairs 30, 22 are situated about the periphery of the cover panel 24. An equal number of notch/engager pairs 30, 22 are situated about the periphery of the base panel 14 and are adapted for mating with the notch/engager pairs 30, 22 of the cover panel 24. Engager 22 is a protrusion extending downwardly from the bottom surface 28 of the cover panel 24 or upwardly from the top surface 16 of the of the base panel 14. Engager 22 is generally perpendicular to the plane of the panel from which it extends.

Two notch/engager pairs 30, 22 intended for mating with each other are transposed with respect to each other. A notch/engager pair 30, 22 appearing on the cover panel 24 is positioned so that upon placement of the cover panel 24 onto the base panel 14, the cover panel engager 22C fits within the base panel notch 30B and the base panel engager 22B fits within the cover panel notch 30C. The cover and base panel engagers 22C, 22B are adapted for slidably engaging one another.

Specifically, a portion of an engager 22 extends across a portion of its associated notch 30. Thus, in the case of notch/engager pairs 30, 22 appearing on the cover panel 24, each notch/engager pair 30, 22 forms a ledge-like structure L. In the case of notch/engager pairs 30, 22 appearing on the base panel 14, each notch/engager pair 30, 22 forms an overhang-type structure 0. The ledge-like structure L of a notch/engager pair 30, 22 appearing on the cover panel 24 and the overhang-like structure 0 of a notch/engager pair 30, 22 appearing on the base panel 14 are complimentary and adapted for slidably engaging one another.

At least two notch/engager pairs 30, 22 are required to secure the cover panel 24 to the base panel 14. The two notch/engager pairs 30, 22 must be advantageously positioned in opposition with respect to each other. In the preferred embodiment, a total of four notch/engager pairs 30, 22 secure the cover panel 24 to the base panel 14. Each side 10S of the card display holder carries two notch/engager pairs 30, 22.

Figure 15:
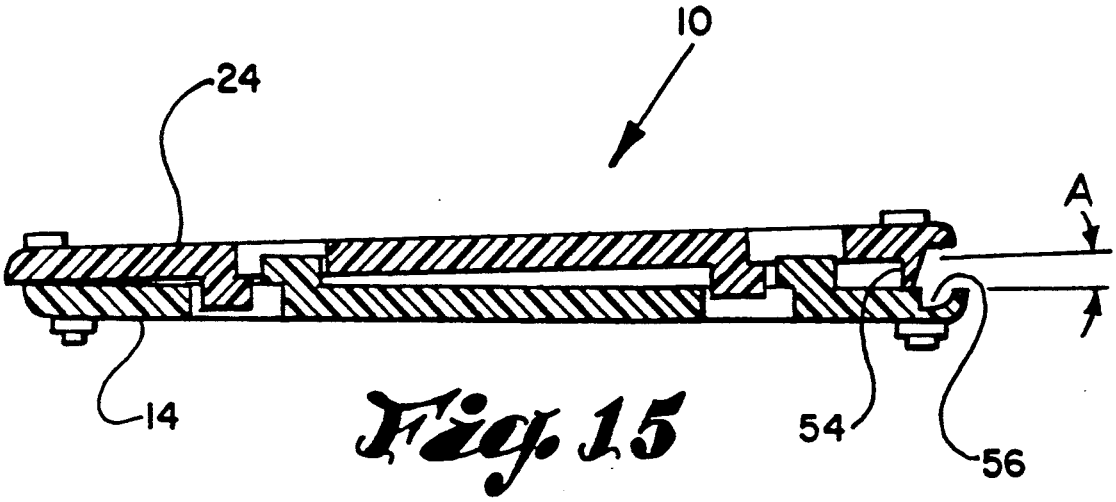
FIG. 15 is a side elevation of the cover and base panels in an unlocked position.

The invention is also provided with means 52 for locking and unlocking the cover panel 24 to the base panel 14. Locking and unlocking means 52 include at least one extension 54 extending downwardly from the outer periphery of one end 10E of the cover panel 24, and a cavity 56 within the base panel 14 adapted for receiving and engaging the extension or extensions 54. Upon placement of the cover panel 24 onto the base panel 14 such that the notch/engager pairs 30, 22 of the cover panel 24 slidably engage the notch/engager pairs 30, 22 of the base panel 14, an acute angle A is formed by the cover 24 and base 14 panels, when viewed from a side elevation view, as in FIG. 15. The extension 54 appearing at the periphery of one end of the cover panel 24 forms the angle A by raising that end of the cover panel 24 away from the bottom surface 18 of the base panel 14. The cover panel 24 is locked to the base panel 14 by urging the extension 54 of the cover panel 24 in the direction of the cavity 56 of the base panel 14. Engagement of the extension 54 with the cavity 56 results in full engagement of the notch/engager pairs 30C, 22C of the cover panel 24 with the notch/engager pairs 30B, 22B of the base panel 14, and in the bottom surface 28 of the cover panel 24 being flush with the top surface 16 of the base panel 14. Once locked, the cover and base panels 24, 14 are unlocked by the application of concurrent vertical and horizontal pressure to the cover panel at position X. In the preferred embodiment, the extension/cavity 54, 56 combination is adapted to receive a prying device 58, such as a coin. By inserting the coin 58 and levering it against the edge of the cover panel 24, the cover panel 24 is detached from the base panel 14. Other suitable prying devices include a key, knife, fingernail file or clipper, screwdriver, or similar tool.

Figure 16:
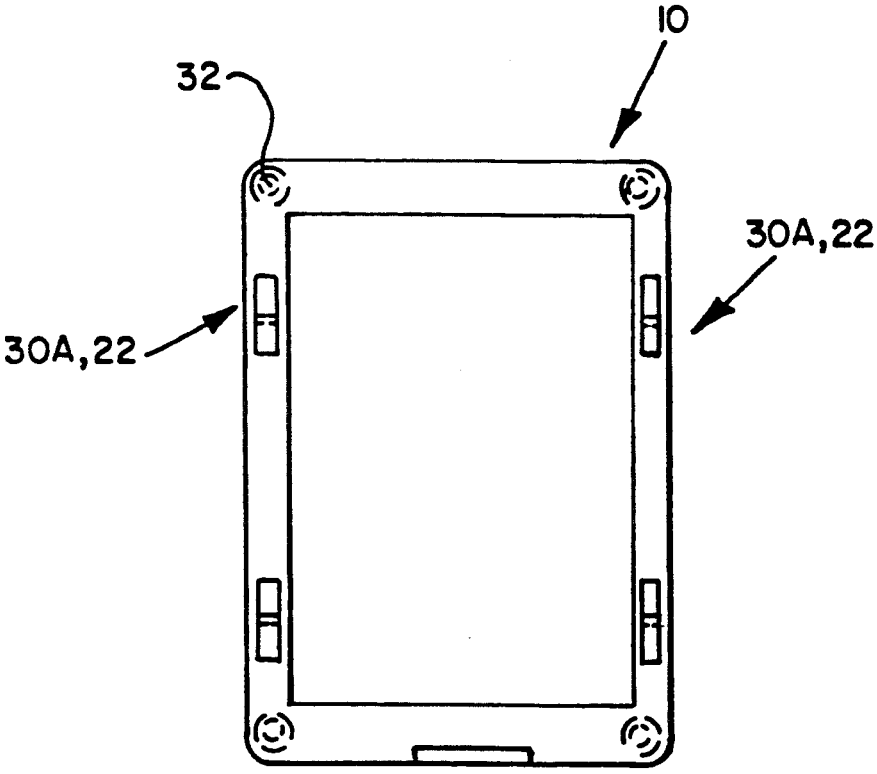
FIG. 16 is alternate embodiment of the invention illustrating alternate placement of the notch/engager pairs.

In the preferred embodiment, the notch/engager pairs 30, 22 are positioned on the outer periphery of the cover and base panels 24, 14, and notches 30 are formed by cutting out areas along the exterior edges of the two panels. Alternatively, as shown in FIG. 16, the notch/engager pairs 30A, 22 may be positioned slightly interior to the outer periphery of the panels. Thus, the notches 30A would appear as openings within the cover and base panels 24, 14. The alternative notch/engager pairs 30A, 22 are positioned advantageously to avoid any obstruction to viewing the display item within the card display holder 10.

In the preferred embodiment, the base panel 14 and the cover panel 24 are made of clear polystyrene, although other transparent plastics can be used. Also, in the preferred embodiment, the top surface 26 of the cover panel 24 carries indentations 32. A plurality of protuberances 34 on the bottom surface 18 of the base panel 14, in positions corresponding to the indentations 32 on the top surface 26 of the cover panel 24, mate with the indentations 32 of another card display holder 10. The depth of the indentation 32 is less than the height of the protuberance 34, to space stacked card display holders slightly apart, which prevents scratching of the surfaces through which the display item is viewed. Alternatively, the diameter of the protuberance can be greater than that of the indentation, or the protuberance 34 provided with an exterior spacer device, with the same result. In the preferred embodiment, the recessed portion 20 for containing the display item 12 is adapted for receiving a baseball card. Alternatively, as shown in FIG. 9, a plurality of recesses 21A and 21B are provided for containing display items, the configuration of which varies, the recesses being adapted for receiving any of a variety of collector type items, such as coins, stamps, paper currency, newspaper articles, and pictures.

The card display holder 10 may be provided with a detachable support means 46 for positioning the card display holder 10 in an upright position and adjusting the angle of the card display holder 10 for viewing the display item 12, as shown in FIGS. 10 through 12. Preferably, the support 46 is V-shaped (FIG. 12) having holder-engaging gripping means 48 at each end of the support for attachment to the sides of the card display holder 10 by clamping thereon. The support 46 is made of flexible steel, or some other flexible, resilient material, such as plastic, with turned-in ends 48 capable of supporting and gripping the card display holder 10. The width of the V-shaped support 46 is less than the height of the card display holder 10. The narrower the width of the support 46, the greater the range of the viewing angle. The viewing angle of the display item is adjustable by sliding the support 46 up or down the sides of the card display holder 10, as seen in FIGS. 10 and 11.

SUMMARY OF THE ACHIEVEMENTS OF THE OBJECTS OF THE INVENTION

From the foregoing, it is readily apparent that we have invented a device for providing baseball card collectors and dealers with a product that holds, protects and displays a single baseball card that is quick and simple to use, providing a positive locking mechanism for securing the card in the card display holder, providing a card display holder that is designed so that each card display holder has a recess and mating protrusion on each corner that allows card display holders to be stacked on each other for transportation and storage without scratching or damaging one another, and providing a card display holder for display of other small items, such as stamps, coins, paper currency, newspaper articles, and pictures.

It is to be understood that the foregoing description and specific embodiments are merely illustrative of the best mode of the invention and the principles thereof, and that various modifications and additions may be made to the device by those skilled in the art, without departing from the spirit and scope of this invention, which is therefore understood to be limited only by the scope of the appended claims.

We claim:

1. A card display holder for receiving and containing a display item, comprising:

(a) a clear base panel having a top surface and a bottom surface and a surface area greater than that of the display item, the top surface having a recess therein for containing the display item and at least two notch/engager pairs spaced around a periphery of the base panel, each of the notch/engager pairs of the base panel including a notch in the clear base panel and an engager extending upwardly from the top surface of the base panel;

(b) a separate clear cover panel having a top surface and a flat bottom surface and a surface area greater than that of the display item, and having notch/engager pairs spaced around a periphery of the cover panel in positions corresponding to the notch/engager pairs on the top surface of the base panel and adapted for matching with the notch/engager pairs of the base panel, each of the notch/engager pairs of the cover panel including a notch in the clear cover panel and an engager extending downwardly from the bottom surface of the cover panel, wherein the notch/engager pairs on the cover panel are so positioned that, upon placement of the cover panel onto the base panel, each of the engagers of the cover panel fits within one of the notches of the base panel and each of the engagers of the base panel and each fits within of the engagers of the base panel and the engagers one of the notches of the cover panel slidably of the cover and base panels are engageable with one another, wherein a portion of each of the engagers of the cover and base panels extends across a portion of its associated notch, each of the notch/engager pairs of the cover panel defines a ledge-like structure, and each of the notch/engager pairs of the base panel defines an overhang-type structure; and (c) means for locking and unlocking the cover panel to and from the base panel.

2. The card display holder according to claim 1, wherein the ledge-like structure and the overhang-type structure are complimentary and adapted for slidably engaging one another.

3. The card display holder according to claim 1, wherein the base panel and the cover panel are rectangular.

4. The card display holder according to claim 1, wherein said card display holder has two opposed sides and two opposed ends, each side of the card display holder having two notch/engager pairs.

5. The card display holder according to claim 1, wherein the locking and unlocking means include at least one extension extending downwardly from the outer periphery of one end of the cover panel, and a cavity within the base panel adapted for receiving and engaging the extension or extensions.

6. The card display holder according to claim 5, wherein, upon placement of the cover panel onto the base panel such that the notch/engager pairs of the cover panel slidably engage the notch/engager pairs of the base panel, the extension does not engage the cavity and an acute angle is thus formed by the cover and base panels, when viewed from a side elevation view, by the extension separating one end of the cover panel from the base panel.

7. The card display holder according to claim 5, wherein the cover panel is adapted for locking to the base panel by urging the extension of the cover panel in the direction of the cavity of the base panel, and engagement of the extension with the cavity.

8. The card display holder according to claim 5, wherein the cover and base panels are adapted for unlocking by the application of concurrent vertical and horizontal pressure to the cover panel at a predetermined position on the locking and unlocking means.

9. The card display holder according to claim 8, said extension or extensions being received and engaged by said cavity to form an extension/cavity combination, wherein said extension/cavity combination is adapted to receive a prying means, whereby the concurrent vertical and horizontal pressure is provided by urging the prying means against the edge of the cover panel.

10. The card display holder according to claim 1, wherein the notch/engager pairs are positioned on the outer periphery of an cover and base panels, the notches being formed by cutting out areas along the exterior edges of the two panels.

11. The card display holder according to claim 1, wherein the notch/engager pairs are positioned slightly interior to an cover and base panels, the notches being openings within the cover and base panels, and the notch/engager pairs being positioned advantageously to avoid any obstruction to viewing the display item within the card display holder.

12. The card display holder according to claim 1, wherein the base panel and the cover panel are clear polystrene.

13. The card display holder according to claim 1, wherein the cover and base panels are rounded.

14. The card display holder according to claim 1, further comprising the top surface of the cover panel having a plurality of indentations thereon, and a plurality of protuberances on the bottom surface of the base panel, adapted for mating with a second similarly configured card display holder.

15. The card display holder according to claim 1, wherein the recess for containing the display item is adapted for receiving a baseball card.

16. The card display holder according to claim 1, further comprising a plurality of recesses in the base panel for containing display items.

17. The card display holder according to claim 16, wherein the plurality of recesses are adapted for receiving coins.

18. The card display holder according to claim 16, wherein the plurality of recesses are adapted for receiving stamps.

19. The card display holder according to claim 1, wherein the recess is adapted for receiving paper currency.

20. The card display holder according to claim 1, wherein the recess is adapted for receiving a newspaper article.

21. The card display holder according to claim 1, wherein the recess is adapted for receiving a picture.

22. The card display holder according to claim 1, further comprising said card display holder having sides, wherein said card display holder is supported by a unitary V-shaped support, made of a resilient material, having gripping means at each end of the support for attachment to the sides of the card display holder, the gripping means adapted for slidable positioning at locations along the card display holder, for varying the viewing angle of the card display holder.

23. A card display holder for receiving and containing a display item, comprising:

(a) a clear base panel having a top surface and a bottom surface and a surface area greater than that of the display item, the top surface having a recess therein for containing the display item and at least two notch/engager pairs spaced around the periphery of the base panel, each of the notch/engager pairs of the base panel including a notch in the base panel and an engager extending upwardly from the top surface of the base panel;

(b) a separate clear cover panel having a top surface and a flat bottom surface and a surface area greater than that of the display item, and having notch/engager pairs spaced around the periphery of the cover panel in positions corresponding to the notch/engager pairs on the top surface of the base panel and adapted for mating with the notch/engager pairs of each of the notch/engager pairs of the cover panel including a notch in the cover panel and an engager extending downwardly from the bottom surface of the cover panel, wherein a portion of each of the engagers of the cover and base panels extends across a portion of its associated notch, each of the pairs of the cover panel notch/engager defines a ledge-like structure, and each of the pairs of the base notch/engager panel defines an overhang-type structure; and (c) means for locking and unlocking the cover panel to and from the base panel, wherein the locking and unlocking means include at least one extension extending downwardly from an outer periphery of one end of the cover panel, and a cavity within the base panel adapted for receiving and engaging the extension or extensions, wherein, upon placement of the cover panel onto the base panel such that the notch/engager pairs of the cover panel slidably engage the notch/engager pairs of the base panel, the extension does not engage the cavity and an acute angle is thus formed by the cover and base panels, when viewed from a side elevation view, by the extension separating one end of the cover panel from the base panel.

* * * * *